United States Patent [19]

Courvoisier et al.

[11] Patent Number: 4,665,308

[45] Date of Patent: May 12, 1987

[54] ELECTRICAL HEATING ELEMENT INTENDED TO BE INCORPORATED IN AN INNER LINING OF AN ITEM OF CLOTHING OR ACCESSORY INTENDED TO BE PLACED AGAINST A PART OF THE HUMAN BODY

[75] Inventors: Guy Courvoisier; Simon Arieh, both of Geneva, Switzerland

[73] Assignee: Lange International S.A., Fribourg, Switzerland

[21] Appl. No.: 801,510

[22] Filed: Nov. 25, 1985

Related U.S. Application Data

[63] Continuation of Ser. No. 603,556, Apr. 24, 1984, abandoned.

[30] Foreign Application Priority Data

May 2, 1983 [CH] Switzerland ..... 2354/83

[51] Int. Cl.[4] ..... H05B 3/10

[52] U.S. Cl. ..... 219/548; 36/2.6; 219/211; 219/527; 219/528

[58] Field of Search ..... 219/211, 548, 527, 528, 219/529; 36/2.6

[56] References Cited

U.S. PATENT DOCUMENTS

| | | | |
|---|---|---|---|
| 1,036,632 | 8/1912 | Jahr | 338/208 X |
| 2,028,347 | 1/1936 | Pelosi | 219/211 X |
| 2,456,468 | 12/1948 | Theodore | 219/212 |
| 2,458,119 | 1/1949 | Van Daam | 219/211 |
| 2,817,737 | 12/1957 | Morris | 219/545 X |
| 2,834,862 | 5/1958 | Mayers | 219/528 X |
| 2,845,519 | 7/1958 | Willat | 219/528 |
| 2,858,410 | 10/1958 | Rich | 219/211 X |
| 2,889,445 | 6/1959 | Wolf | 219/549 X |
| 2,948,802 | 8/1960 | Shaw | 219/212 |
| 3,010,007 | 11/1961 | Theodore et al. | 219/345 |
| 3,031,739 | 5/1962 | Boggs | 219/345 X |
| 3,047,701 | 7/1962 | Frungel | 338/208 X |
| 3,108,596 | 10/1963 | Veach | 219/527 X |
| 3,130,289 | 4/1964 | Katzman et al. | 219/528 X |
| 3,153,140 | 10/1964 | Theodore et al. | 219/549 |
| 3,253,405 | 12/1966 | Costanzo | 219/211 |
| 3,534,391 | 10/1970 | Bauer | 219/211 |
| 3,904,850 | 9/1975 | Johnson | 219/528 |
| 3,946,193 | 3/1976 | Giese | 219/211 |
| 4,220,848 | 9/1980 | McMullan et al. | 219/528 |
| 4,294,003 | 10/1981 | Coverstone | 219/345 X |
| 4,507,877 | 4/1985 | Vaccari et al. | 219/211 X |

FOREIGN PATENT DOCUMENTS

| | | | |
|---|---|---|---|
| 99363 | 3/1925 | Austria | 219/528 |
| 716215 | 8/1965 | Canada | 219/528 |
| 1015740 | 10/1952 | France | 219/528 |
| 838497 | 6/1960 | United Kingdom | 219/528 |

*Primary Examiner*—C. L. Albritton

*Attorney, Agent, or Firm*—Brumbaugh, Graves, Donohue & Raymond

[57] ABSTRACT

An electrical heating element intended to be incorporated in an inner lining of an item of clothing or accessory intended to be placed against a part of the human body, in which the heating element is formed by a ductile metal wire coated with an insulating lacquer, for example a commercially available insulated copper wire, fixed over its entire length to at least one metal sheet, preferably a sheet of aluminium having an adhesive side to which the wire is adhered. The wire can be disposed in meanders. It may be covered by an insulating sheet, and the metal sheet may have cut-outs therein.

4 Claims, 5 Drawing Figures

ELECTRICAL HEATING ELEMENT INTENDED TO BE INCORPORATED IN AN INNER LINING OF AN ITEM OF CLOTHING OR ACCESSORY INTENDED TO BE PLACED AGAINST A PART OF THE HUMAN BODY

This application is a continuation of application Ser. No. 603,556, filed on Apr. 24, 1984, now abandoned.

This invention relates to an electrical heating element intended to be incorporated in an inner lining of an item of clothing or an accessory intended to be placed against a part of the human body.

BACKGROUND OF THE INVENTION

The U.S. Pat. No. 4,433,494 describes a method for obtaining an item of clothing or accessory, in particular a ski boot, closely fitted to part of the human body, by the thermo-forming of an inner lining of thermo-formable material, by means of an electrical heating element incorporated in said lining, this lining and the part of the human body in question being placed mutually under pressure after having heated the lining to its thermo-forming temperature by means of the heating element. The heating element used is obtained by the chemical attack of a polyester support coated with a layer of aluminium, in order to form a meander able to constitute a heating element of sufficient length. However, when in use, it has been found that if this heating element is heated several times, the polyester hardens and causes fractures of the aluminium, i.e. cutting of the heating element which thus becomes unusable. In any case, thin aluminium does not behave well under stress and fractures or tears rapidly when it is subjected to repeated bending stress, as is the case for example in an inner lining of a ski boot. Henceforth it is no longer possible to proceed with new thermo-forming, for example in order to refit a ski boot to the feet of the user, nor to use the heating element as a means for heating the item of clothing, for example a boot or glove.

SUMMARY OF THE INVENTION

The main object of the invention is to provide a heating element which withstands repeated bending stresses.

According to the invention the electrical heating element is characterised by a wire of ductile metal coated with an insulating lacquer and fixed over its entire length to at least one metal sheet.

The very thin wire, consisting for example of copper, withstands any bending and even repeated folds, since its diameter is always relatively slight with respect to the radius of curvature of the bend or of the fold. Its small diameter associated with the ductile nature of the metal used means that the heating element even withstands crumpling.

On the other hand, the metal support for the wire reduces the temperature gradient to a negligible value and ensures a virtually uniform distribution of the heat. Since the wire is fixed over its entire length to its metal support, it is in contact with this support at every point, so that no hot spot is formed.

The heating element according to the invention may be used both for the thermo-forming of an inner lining of thermo-formable material and as a heating element intended to heat items of clothing slightly, such as boots or gloves.

BRIEF DESCRIPTION OF THE DRAWINGS

With reference to FIGS. 1 and 2 a copper wire 1 having a diameter of 0.1 mm, coated with an enamel insulating lacquer withstanding a temperature higher than the temperature to which the heating element is raised, when it is used, such as is commercially available, is fixed to an adhesive or self-sticking side 3 of a sheet of aluminium 2 having a thickness of 0.02 mm. One then fixes to this same adhesive side 3 a thin sheet of insulating material 4, for example of MYLAR (registered trade mark), which covers the wire and contribute to keeping it in place, above all preventing its tearing off by friction. The two ends of the wire are connected to electrical supply leads 5 and 6 or cables. Since the wire is insulated, it is quite possible for it to cross itself as represented on FIG. 1.

Figure 1:
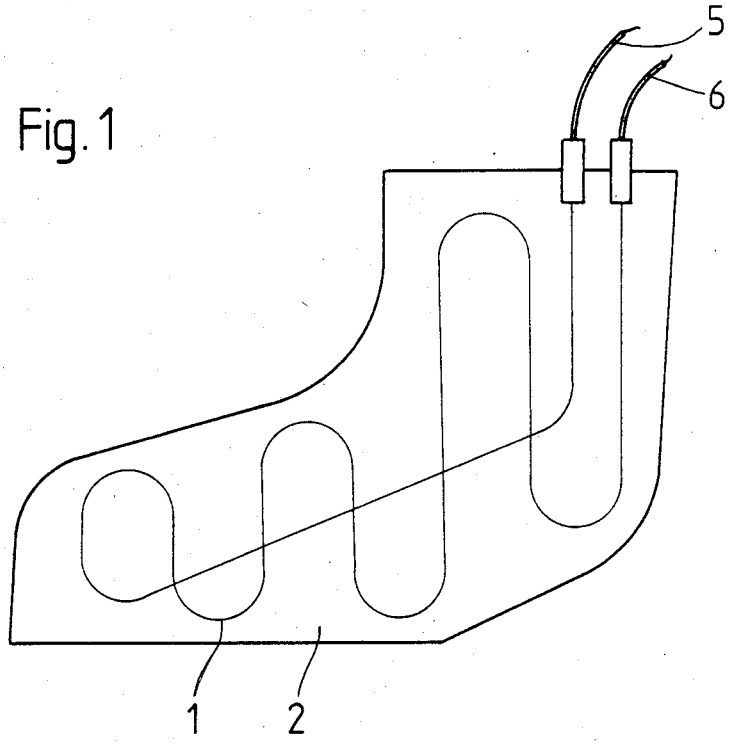
FIG. 1 is a top view of a first embodiment of the invention with a thin sheet of insulating material over the conductors (shown in FIG. 2) omitted in the interests of clarity.
Figure 2:
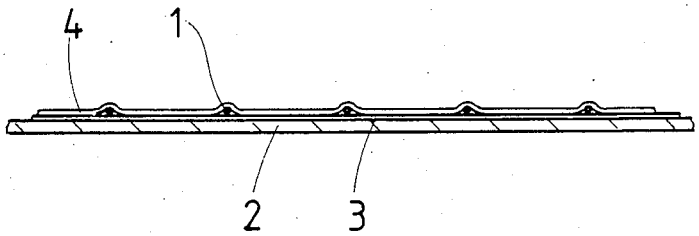
FIG. 2 is a cross sectional view of this first embodiment with the thin sheet of insulating material shown over conductors of the heating element.
Figure 3:
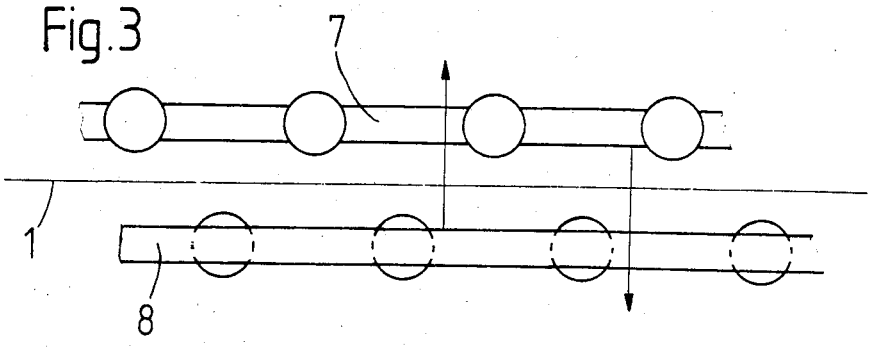
FIG. 3 is a schematical view of means to forming meanders before formation of meanders.
Figure 4:
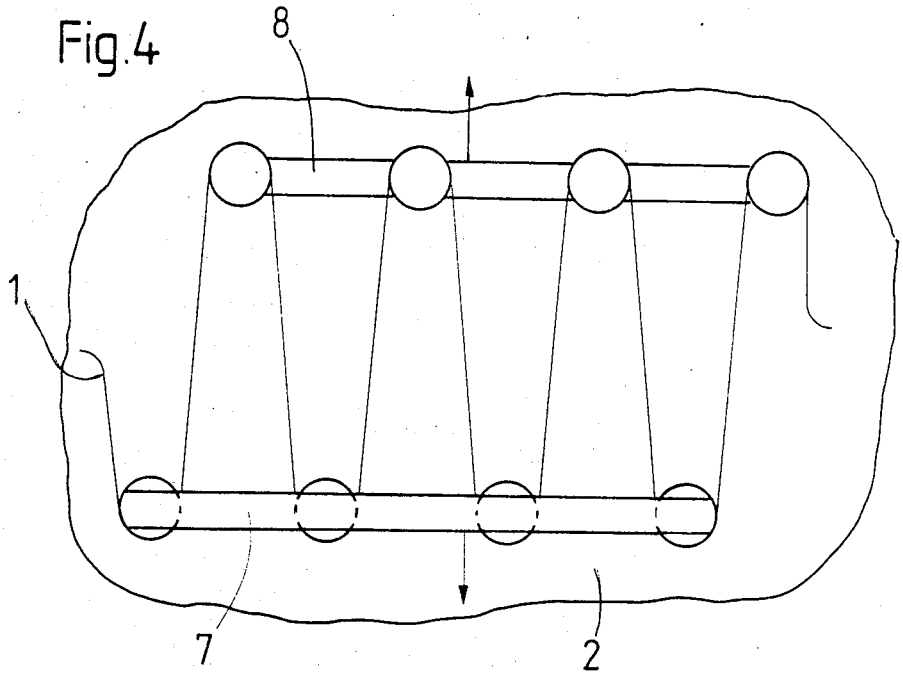
FIG. 4 is a schematical view of the means of FIG. 3 after formation of meanders.

The wire 1 is arranged in meanders, for example in the following manner: the wire is placed in an approximately rectilinear manner, without tension, between two combs, 7 and 8 (FIG. 3) then the combs are crossed as shown in FIG. 4, i.e. the teeth of one of the combs 7 is passed to the other side of the teeth of the other comb 8, thus entraining the wire 1. The latter thus forms a meander between the two combs and it remains solely to press it onto the adhesive side 3 of the aluminium sheet 2 in order to fix it on this sheet.

Figure 5:
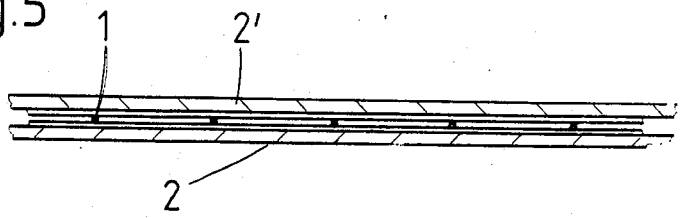
FIG. 5 is a cross sectional view of a second embodiment of the invention.
Figure 1:
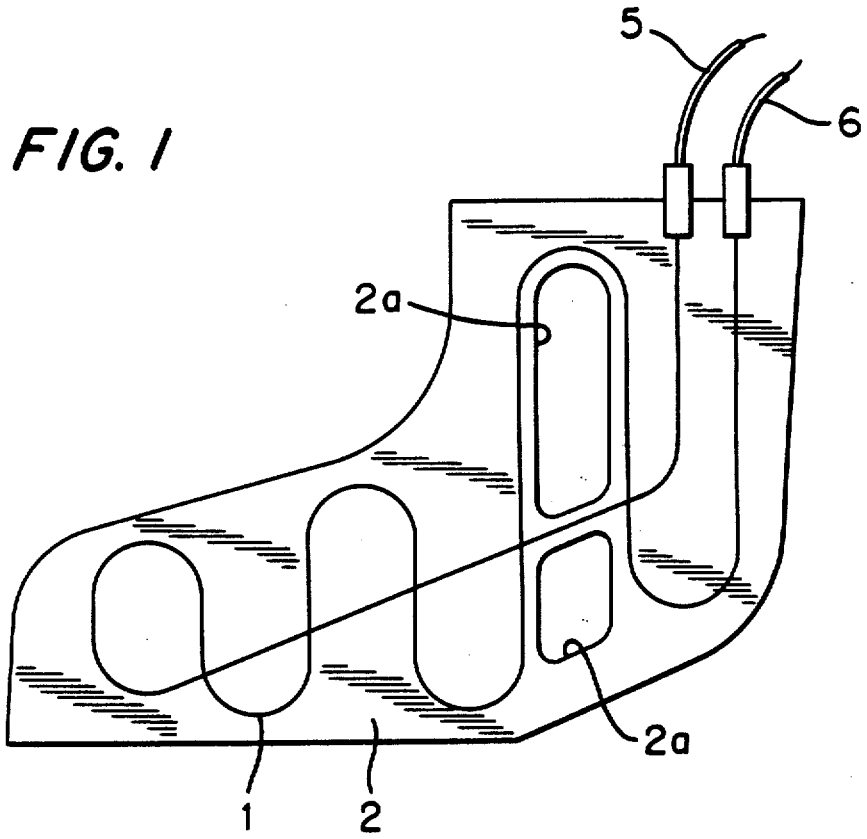
Figure 2:
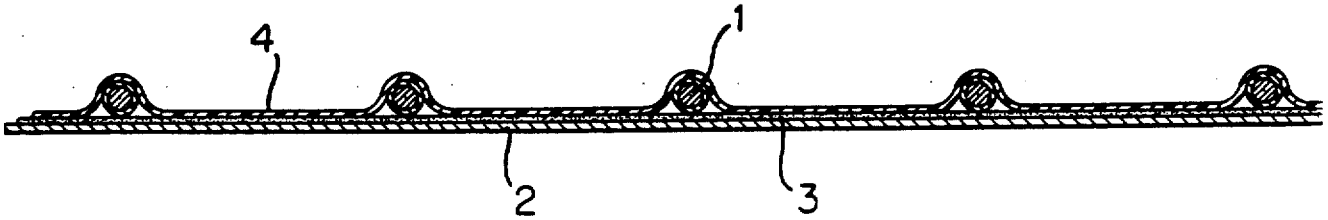
Figure 3:
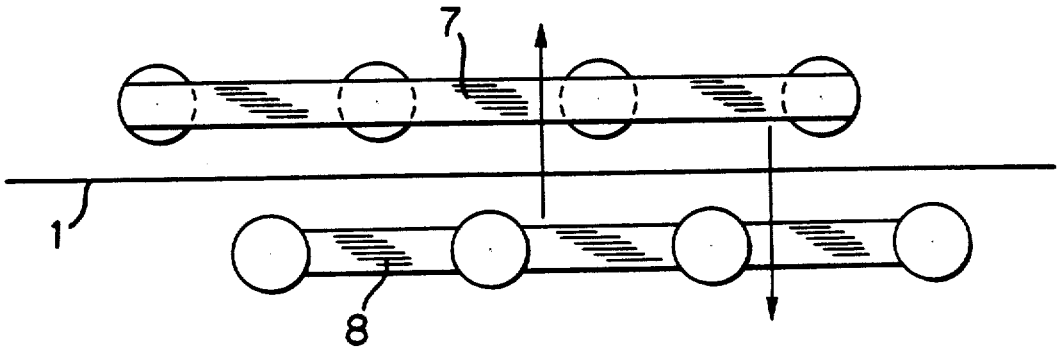
Figure 4:
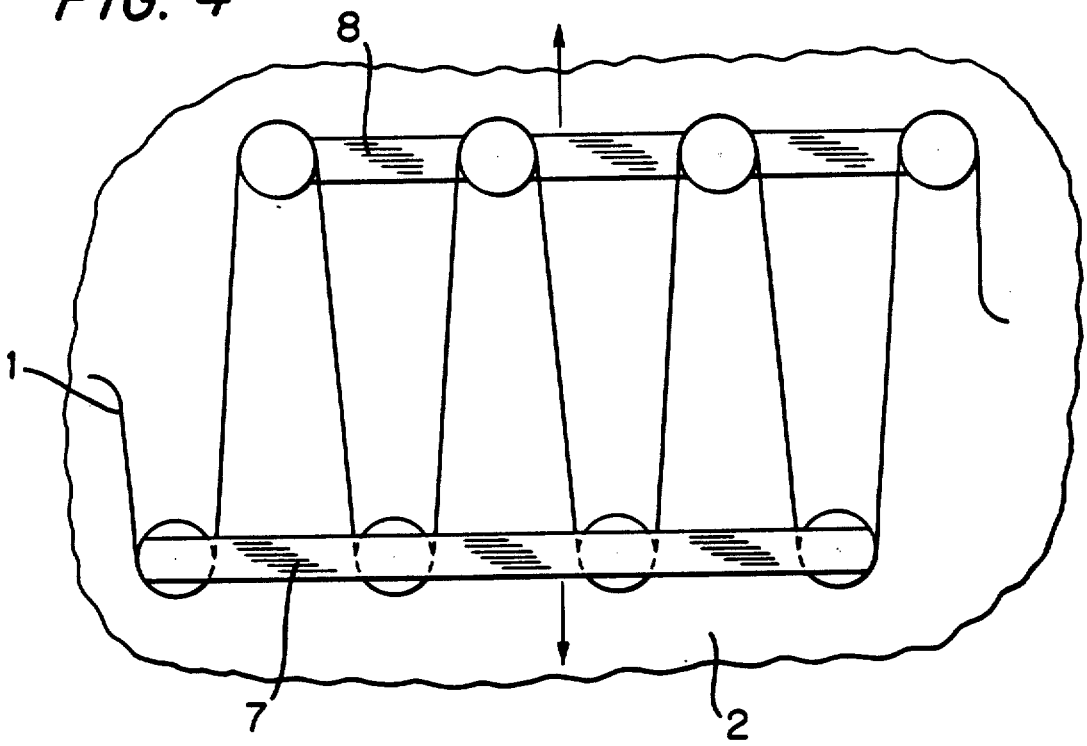
Figure 5:
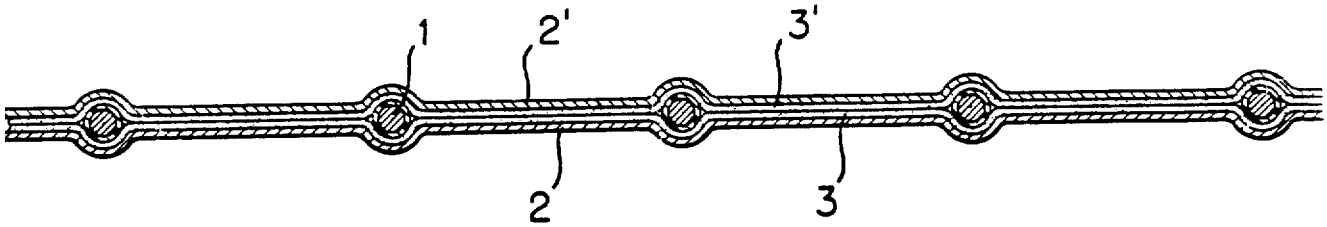

Instead of the sheet of insulating material, it is possible to use a second adhesive sheet of aluminium 2' as shown on FIG. 5, so that the insulated copper wire is fixed to and between two sheets of aluminium 2 and 2', which further increases the contact between the wire and its heat-diffusing support.

In order to produce a heating element for the thermo-forming of an inner lining of a ski boot, a length of copper wire of 2 meters is sufficient. The wire takes up very little surface area and it is easy to control the heating by varying the length of wire per unit of surface area.

The surface of the aluminium sheet may be continuous or perforated by opening **2*a***, for example if one wishes to prevent the heating of certain parts.

Instead of a sheet of aluminium, it is possible to use any other metal sheet. As for the wire, it may be constituted by another ductile metal, for example nickel silver. Generally, the copper wire may have a diameter of 0.1 to 0.4 mm, depending on its use and the metal sheet may have a thickness of between 0.02 and 1 mm. Generally, the metal wire will have a diameter of between 0.05 and 2.5 mm, depending on the nature of the metal and the use of the heating element.

The metal sheet may have any shape, in particular a shape suited to the part of the lining to be heated, respectively thermo-formed, for example one of the shapes described in U.S. Pat. No. 4,433,494.

What is claimed is:

1. An electrical heating element intended to be incorporated into a ski boot inner lining conforming to a human foot, comprising:

a thin flexible metal sheet having a thickness in the range of about 0.02 to 1 mm and having a size, shape and flexibility to conform to the contours of a ski boot liner and ski boot, an adhesive on one side of the sheet, a thin ductile copper wire having a diameter in the range of 0.1 to 0.4 mm capable of withstanding repeated bending stresses and stresses resulting from crumpling without fracturing, an insulating lacquer coated on the ductile wire, the insulating lacquer withstanding a temperature higher than the temperature to which the wire is subjected when heated by a flow of electrical current therethrough, the lacquer coated ductile wire being fixed over its entire length by the adhesive to the thin metal sheet to provide a structure capable of withstanding repeated bending stresses, the wire being formed in meanders on the thin metal sheet to reduce the temperature gradient by conducting heat away from the wire by reason of the metal sheet, thereby providing the heating element with a negligible temperature gradient therealong and eliminating hot spots and affording uniform heat distribution by the heating element to the ski boot inner lining.

2. A heating element according to claim 1, in which the metal wire is covered with a sheet of insulating material.

3. A heating element according to claim 1, in which the metal wire is fixed to and between two metal sheets.

4. A heating element according to claim 1, in which the metal sheet has cut-outs.

* * * * *

UNITED STATES PATENT AND TRADEMARK OFFICE

CERTIFICATE OF CORRECTION

PATENT NO. : 4,665,308

DATED : May 12, 1987

INVENTOR(S) : Guy Courvoisier and Simon Arieh

It is certified that error appears in the above-identified patent and that said Letters Patent is hereby corrected as shown below:

Substitute the attached drawing Figures 1 through 5 for the drawings shown in the Letters Patent.

Signed and Sealed this

Nineteenth Day of January, 1988

*Attest:*

DONALD J. QUIGG

*Attesting Officer*

*Commissioner of Patents and Trademarks*

Patent No. 4,665,308 May 12, 1987

Guy Courvoisier et al.